United States Patent [19]

Brandenburg

[11] 4,405,178

[45] Sep. 20, 1983

[54] CUTTER BIT FOR A MINING MACHINE

[75] Inventor: Helmut Brandenburg, Sprockhovel, Fed. Rep. of Germany

[73] Assignee: Gebr. Eickhoff Maschinenfabrik und Eisengiesserei m.b.H., Bochum, Fed. Rep. of Germany

[21] Appl. No.: 263,480

[22] Filed: May 14, 1981

[30] Foreign Application Priority Data

Jun. 11, 1980 [DE] Fed. Rep. of Germany ..... 3021821

[51] Int. Cl.[3] ..... E21C 35/22

[52] U.S. Cl. ..... 299/81; 299/86; 251/353

[58] Field of Search ..... 299/81, 86; 251/353, 251/354

[56] References Cited

U.S. PATENT DOCUMENTS

| | | | |
|---|---|---|---|
| 3,117,700 | 1/1964 | Gorman | 251/353 |
| 3,270,925 | 9/1966 | Obst | 251/353 |
| 4,251,109 | 2/1981 | Roepke | 299/86 |
| 4,333,687 | 6/1982 | Barnstorf | 299/86 |

FOREIGN PATENT DOCUMENTS

| | | | |
|---|---|---|---|
| 10534 | 4/1980 | European Pat. Off. | 299/81 |
| 2951011 | 7/1981 | Fed. Rep. of Germany | 299/81 |
| 1135193 | 12/1968 | United Kingdom | 299/81 |
| 621873 | 8/1978 | U.S.S.R. | 299/81 |
| 717326 | 2/1980 | U.S.S.R. | 299/81 |

*Primary Examiner*—William F. Pate, III
*Attorney, Agent, or Firm*—Thomas H. Murray

[57] ABSTRACT

A cutter bit assembly for a mining machine cutter head incorporating a novel valve in the form of a resilient sleeve which is deflected to open the valve and conduct fluid through nozzle means at the tip of the bit when the bit is forced into a bore as it engages material being mined.

7 Claims, 2 Drawing Figures

CUTTER BIT FOR A MINING MACHINE

BACKGROUND OF THE INVENTION

Figure 1:
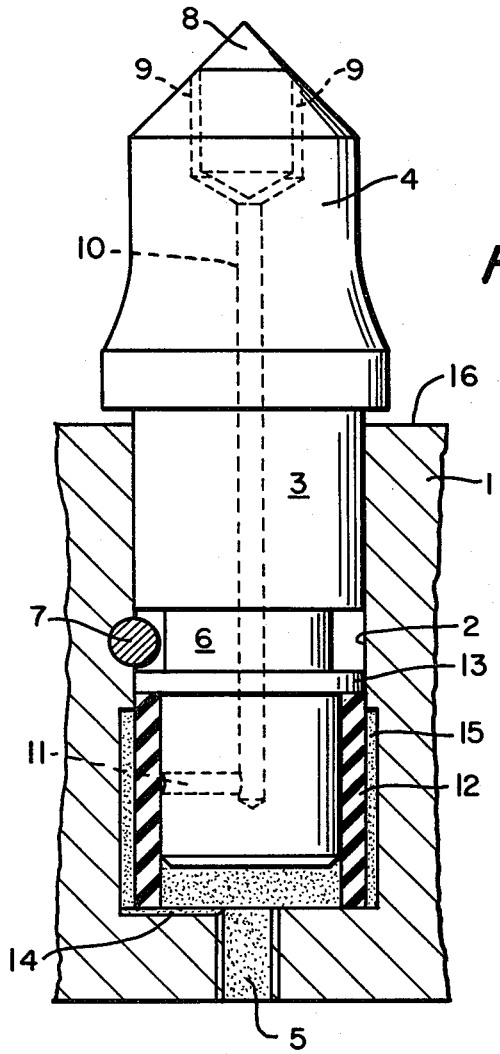

In the past, cutting bits for mining machines have been provided with nozzles at the forward edges thereof for spraying water onto the material being mined. Some of these bits are mounted for limited axial movement in a bore provided in a bit holder, the arrangement being such that as the bit engages and cuts into the material being mined, it will move backwardly into its bore, thereby opening a valve which admits water to the nozzles at the forward end of the bit. Such a bit is shown, for example, on page 988 of the German periodical Gluckauf 1979, No. 20. The bit shown in that publication has a cylindrical shank which reciprocates within a bore provided in a bit holder and is provided with a bore through which water is supplied to the forward end of the bit. The supply of liquid to the nozzle means at the forward end of the bit is controlled through the agency of a valve disposed in a duct which extends parallel to the cutter bit axis. When the bit is not engaging material to be mined, liquid under pressure forces it axially outwardly within the bore in which it is carried; however when the bit drives into the material being mined, the resulting axial loading on the bit forces the same back into its bore until the bit abuts the bottom of the bore, the bit shank moving the aforesaid valve into a position in which the nozzle means at the forward end of the bit communicates with a source of liquid under pressure.

SUMMARY OF THE INVENTION

In accordance with the present invention, a new and improved reciprocating bit assembly is provided incorporating a sleeve-type resilient valve which controls the admission of liquid under pressure to nozzle means at the forward end of the bit.

Specifically, there is provided a bit assembly for a mining machine cutter head comprising a bit having a shank portion reciprocable within a bore formed in a bit holder. The innermost end of the shank portion is of a diameter less than the bore to form a shoulder area at the transition between the innermost end of the bit and the remainder of the shank portion. A passageway is provided in the bit for conducting fluid to nozzle means at the forward end of the bit, the innermost end of the passageway communicating with one or more radial bores which extend to the peripheral surface of the reduced diameter end of the shank. Means are provided for conducting fluid under pressure to the bottom of the bore and the bit holder. A resilient sleeve surrounds the innermost end of the shank portion to normally seal the aforesaid radial bore against fluid flow. This sleeve extends between the shoulder area and a point beyond the innermost end of the shank portion whereby movement of the bit toward the bottom of the bore when the bit engages material to be mined will deflect the resilient sleeve, thereby permitting fluid to flow from the bottom of the bore through the aforesaid passageway to the nozzle means at the forward end of the bit.

Thus, movement of the bit back into the bore in the bit holder will automatically cause fluid, preferably water, to issue from the nozzle means at the forward end of the bit. Since the resilient sleeve is bulged outwardly only while the bit is actually in the material being mined and experiences axial loading, the sleeve will revert instantaneously to its original position where it closes off the supply of fluid to the nozzles when the bit moves away from the bottom of the bore, the action of the sleeve in this respect being assisted by liquid pressure which acts continuously on the outer periphery of the sleeve and helps to provide a fluid-tight closure when the bit is extended outwardly from the bottom of the bore and the bit holder.

Preferably, the sleeve is made of a very resilient rubber; and the end face which bears on the bottom of the bore extends beyond the shank end of the bit by more than the amount of the axial movement which the bit can make. As a consequence, the sleeve is not only suitable for the severe loads it experiences during operation but, because of its increased length, has the resilience necessary to bulge out and admit fluid to the nozzles at the forward end of the bit.

Figure 2:
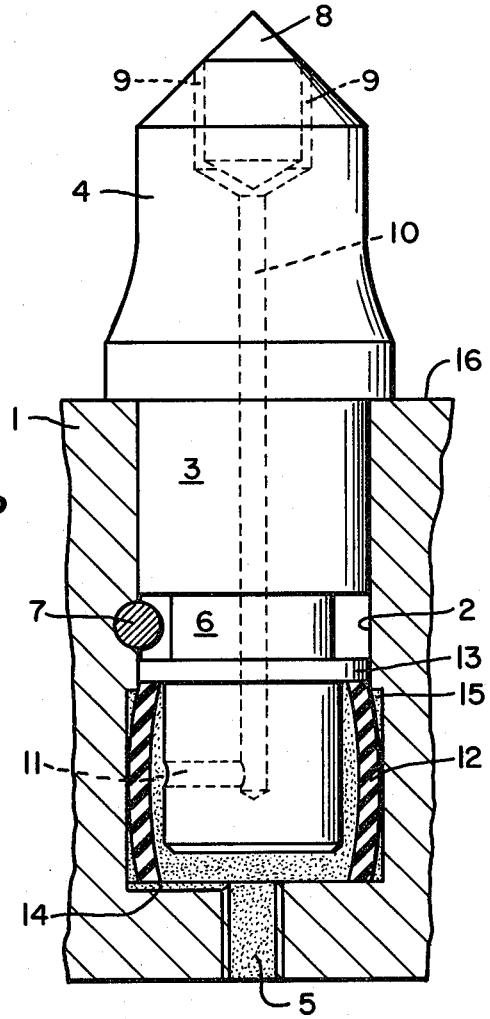

The above and other objects and features of the invention will become apparent from the following detailed description taken in connection with the accompanying drawings which form a part of this specification, and in which:

FIG. 1 is a cross-sectional view of the bit assembly of the invention with the bit shown in its extended position; and FIG. 2 is a view similar to FIG. 1 but wherein the bit is forced backwardly into a bore in a bit holder as it engages material to be mined.

With reference now to the drawings, and particularly to FIG. 1, there is shown a bit holder 1 for a mining machine provided with a longitudinal bore 2. Reciprocable within the bore 2 is the shank portion 3 of a cutter bit 4. Fluid under pressure, preferably water, is introduced into the bottom of the bore via passageway 5.

The shank portion 3 is provided with a reduced diameter portion 6 which forms an annular space into which extends a pin 7. The pin 7 thus permits axial movement of the bit 4 in the bore 3.

The forward, cutting edge 8 of the bit 4 is provided over its periphery with a number of nozzle-like exit orifices 9 which communicate with a central passageway 10 extending axially through the bit. The lower end of the passageway 10, in turn, is connected through one or more radial bores 11 to the peripheral surface of the innermost end of the shank portion 3, this innermost end being of smaller diameter than the remainder of the shank portion.

A resilient rubber sleeve 12 surrounds the innermost reduced diameter portion of the sleeve 3 and extends between a shoulder 13 and the bottom of the bore 2. Surrounding the sleeve 12 is an annular space 15 which communicates through groove or passageway 14 with the inlet 5. In this manner, the area around the sleeve is pressurized by fluid entering the bore 2 through passageway 5 and assists in holding the sleeve in snug, abutting relationship with the innermost end of the shank to thereby provide an effective seal and prevent fluid from flowing through bore 11 and passageway 10 to the nozzles 9.

In FIG. 1, the bit is shown in its extended position where the sleeve 12 acts as an effective seal. However, when the bit engages material to be mined, it will move into engagement with surface 16 of the bit holder 1 as shown in FIG. 2. This causes the resilient sleeve 12 to bulge outwardly as shown in FIG. 2, thereby permitting fluid under pressure in the bottom of the bore 2 to flow through bore 11 and passageway 10 to the nozzles 9. On the other hand, as soon as the bit disengages from the material being mined, it will again assume the position shown in FIG. 1 where the sleeve 12 seals off the bore 11 and prevents the flow of fluid of the nozzles 9.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A bit assembly for a mining machine cutter head comprising a bit having a shank portion reciprocable within a bore formed in a bit holder, the innermost end of the shank portion being of diameter less than the bore to form a shoulder area at the transition between said innermost end and the remainder of the shank portion, a passageway in the bit for conducting fluid to nozzle means at the forward end of the bit, radial bore means connecting said passageway to the peripheral surface of said innermost end of the shank portion, means for conducting fluid under pressure to the bottom of the bore in said bit holder, and a resilient sleeve surrounding said innermost end of the shank portion to normally seal said radial bore means against fluid flow, the sleeve extending between said shoulder area and a point beyond said innermost end of the shank portion whereby movement of the bit toward said bottom of the bore will deflect the resilient sleeve to permit fluid to flow from said bottom of the bore through said radial bore means and said passageway to said nozzle means.

2. The bit assembly of claim 1 including an annular space surrounding said resilient sleeve, and means for applying fluid under pressure to said annular space whereby said fluid under pressure will hold the resilient sleeve in sealing engagement with the outer peripheral surface of said innermost end of the shank portion.

3. The bit assembly of claim 2 including passageway means connecting said annular space to the bottom of said bore.

4. The bit assembly of claim 1 including means for limiting reciprocating movement of said bit within said bore.

5. The bit assembly of claim 1 wherein said sleeve extends between said shoulder area and the bottom of said bore.

6. The bit assembly of claim 5 wherein said resilient sleeve will bow outwardly when compressed between said shoulder area and the bottom of said bore to permit fluid to flow from the bottom of the bore to said radial bore means and said passageway.

7. The bit assembly of claim 1 wherein said sleeve extends beyond said innermost end of the shank portion.

* * * * *